US008458890B2

(12) United States Patent
Sakamoto

(10) Patent No.: US 8,458,890 B2
(45) Date of Patent: Jun. 11, 2013

(54) COIL COMPONENT AND METHOD FOR MANUFACTURING COIL COMPONENT

(75) Inventor: Shinichi Sakamoto, Tokyo (JP)

(73) Assignee: Sumida Corporation (JP)

( * ) Notice: Subject to any disclaimer, the term of this patent is extended or adjusted under 35 U.S.C. 154(b) by 0 days.

(21) Appl. No.: 12/673,632

(22) PCT Filed: Jun. 6, 2008

(86) PCT No.: PCT/JP2008/060429

§ 371 (c)(1),
(2), (4) Date: Feb. 16, 2010

(87) PCT Pub. No.: WO2009/028247

PCT Pub. Date: Mar. 5, 2009

(65) Prior Publication Data

US 2011/0006870 A1 Jan. 13, 2011

(30) Foreign Application Priority Data

Aug. 31, 2007 (JP) ..... 2007-226987

(51) Int. Cl.
*H01F 7/06* (2006.01)
*H01F 27/02* (2006.01)

(52) U.S. Cl.
USPC ..... 29/602.1; 336/83; 336/90

(58) Field of Classification Search
USPC ..... 336/83, 90
See application file for complete search history.

(56) References Cited

U.S. PATENT DOCUMENTS

| | | | | |
|---|---|---|---|---|
| 4,511,872 | A * | 4/1985 | Olmsted et al. | 336/83 |
| 5,457,872 | A * | 10/1995 | Sakata et al. | 29/605 |
| 6,087,920 | A * | 7/2000 | Abramov | 336/192 |
| 2006/0012457 | A1 * | 1/2006 | Reppe et al. | 336/212 |
| 2006/0119461 | A1 | 6/2006 | Kawarai | |
| 2006/0186978 | A1 * | 8/2006 | Kawarai | 336/83 |
| 2006/0186979 | A1 | 8/2006 | Kawarai | |

FOREIGN PATENT DOCUMENTS

| | | | |
|---|---|---|---|
| EP | 1895549 | A1 * | 3/2008 |
| JP | 2001185421 | A | 7/2001 |
| JP | 2003297642 | A | 10/2003 |
| JP | 2004128455 | A | 4/2004 |
| JP | 2004281778 | A | 10/2004 |

(Continued)

OTHER PUBLICATIONS

English translation of JP 2006-237248. Takahashi et al., Ceramic Green Material, Manufacturing Method Thereof, Ceramic Sintered Material, Manufacturing Method Thereof, Ferrite Core, Manufacturing Method Thereof, and Coil Component, Sep. 7, 2006.*

(Continued)

*Primary Examiner* — Mohamad Musleh
*Assistant Examiner* — Tsz Chan
(74) *Attorney, Agent, or Firm* — Lerner, David, Littenberg, Krumholz & Mentlik, LLP

(57) ABSTRACT

In an inductor including a coil, a drum type core constituted by a soft magnetic metal material and a resin material, and a filling member constituted by a soft magnetic metal material and a resin material in which a magnetic flux excited by aforesaid coil goes through aforesaid drum type core and aforesaid filling member serially, the present invention constitutes an inductor, wherein aforesaid drum type core is constituted by injection molding so as to include a receiving portion, aforesaid coil is arranged in aforesaid receiving portion, and aforesaid filling member is filled therein.

3 Claims, 8 Drawing Sheets

FOREIGN PATENT DOCUMENTS

| | | | |
|---|---|---|---|
| JP | 2006237248 | A | 9/2006 |
| KR | 20000071002 | | 11/2000 |
| KR | 20050056863 | | 6/2005 |
| WO | 98/35367 | A1 | 8/1998 |

OTHER PUBLICATIONS

International Search Report, PCT/JP2008/060429, dated Jul. 2, 2008.

* cited by examiner

COIL COMPONENT AND METHOD FOR MANUFACTURING COIL COMPONENT

TECHNICAL FIELD

The present invention relates to a coil component and a manufacturing method of the coil component, and more particularly, relates to a small-sized coil component used in an electronic apparatus and a manufacturing method of the coil component.

BACKGROUND ART

In recent years, along with miniaturization of an electronic apparatus, a request for miniaturization with respect to a coil component of an inductor or the like has been issued strongly. When forming an inductor in a small size, for example, thickness of a flange included in a core becomes thin and there will occur such a problem that strength of the inductor lowers.

In order to solve this problem, there is known a technology in which a core forming a post shape is molded by using a compound member obtained by mixing a function material powder and a resin, whose strength is higher than that of a sintered core composed of ferrite core or the like (for example, see Japanese unexamined patent publication No. 2003-297642). Also, a technology is known for reducing the leakage of magnetic flux in which there is used a sintered ferrite core or a pressed powder magnetic core made of metal magnetic powders, and a compound member obtained by mixing metal magnetic material powders and resin is filled in a coil portion including a coil arranged for the core (for example, see Japanese unexamined patent publication Nos. 2001-185421 and 2004-281778).

However, according to the technology disclosed in the above-mentioned Japanese unexamined patent publication No. 2003-297642, extrusion molding is used and therefore, only a post shaped core can be molded and it is not possible to mold a core of a complex shape. In addition, there are included a process for winding a wire member around a extrusion core member, a process for cutting the extrusion core member, and a process for covering an external cladding at a coil periphery portion and the like, and there arises a fear of a large scale production facility and also of an increase in the facility cost. Also, in the technology disclosed in Japanese unexamined patent publication Nos. 2001-185421 and 2004-281778, there is used sintered ferrite material or a pressed powder magnetic material of metal magnetic powders for a core, so that there is a trend that the thickness of the core becomes thin in case of miniaturizing the electric component and it is difficult to get enough strength thereof.

SUMMARY OF THE INVENTION

The present invention takes the matter mentioned above into consideration and it is possible to get enough strength with respect to the shock of a core falling or the like compared with a sintered core even if the electric component becomes small sized. Also, by injection-molding a core having a receiving portion, it is possible to fill the aforesaid compound magnetic resin easily in the receiving portion of the core, and there is offered a coil component in which leakage magnetic flux is little and the electric characteristic is excellent and there is offered a manufacturing method of the coil component thereof.

The present invention was invented in order to achieve the objects such as mentioned above and these objects can be achieved by the following inventions (1) to (3).

(1) A coil component, including:

a compound magnetic core formed by injection molding into mateable die portions a mixture including a first soft magnetic metal material and a first resin material, the compound magnetic core including a receiving portion, a parting line formed by the mateable die portions, and a recessed groove formed along portions of the parting line in the receiving portion;

a coil arranged in the receiving portion; and a compound magnetic resin including a second soft magnetic metal material and a second resin material arranged in the receiving portion over the coil, wherein magnetic flux excited by the coil serially goes through the compound magnetic core and the compound magnetic resin.

(2) The coil component described in the above (1), wherein the first resin material is a thermo-setting resin material or a thermoplastic resin material.

(3) A method of manufacturing a coil component, including:

forming a compound magnetic core by injection-molding into a die a mixture including a first soft magnetic metal material and a first resin material, the compound magnetic core having a receiving portion and a longitudinal plane of symmetry, the die including a first die portion for forming one portion of the compound magnetic core and a second die portion for forming another portion of the compound magnetic core, the first die portion and the second die portion being mateable at the longitudinal plane of symmetry to define a parting line on the compound magnetic core, the first die portion and the second die portion including features for forming a recessed groove along portions of the parting line in the receiving portion;

assembling a coil in the receiving portion of the compound magnetic core; and arranging a compound material including a second soft magnetic metal material and a second resin material in the compound magnetic core so as to coat the coil.

According to a coil component based on the present invention, it is possible to improve impact resistance capability compared with that of a sintered ferrite core or the like by injecting a compound material which includes a magnetic material and a resin material to mold the core, and it is possible to prevent core damage of a core crack or the like. In addition, by using the aforesaid compound material and by filling the compound material composed of the magnetic material and the resin material also for the coil portion, it is possible to improve not only the impact resistance capability but also withstand voltage property or anticorrosion property.

According to a method of manufacturing the coil component based on the present invention, it is possible to manufacture a complexly shaped core easily by using injection-molding and in addition, differently from a method of manufacturing a ferrite sintered core or the like, a process referred to as cutting is not necessary, so that it is possible to attempt improvement of the yield and improvement of the core productivity.

DETAILED DESCRIPTION

Hereinafter, it will be explained with respect to one exemplified embodiment for practicing a coil component relating to the present invention with reference to the drawings, but the present invention is not limited by the exemplified embodiments hereinafter. Also, the manufacturing method of the coil component relating to the present invention will be explained together with the coil component.

First Exemplified Embodiment

First, a first exemplified embodiment of a coil component of the present invention will be explained with reference to FIGS. 1-5.

Figure 1:
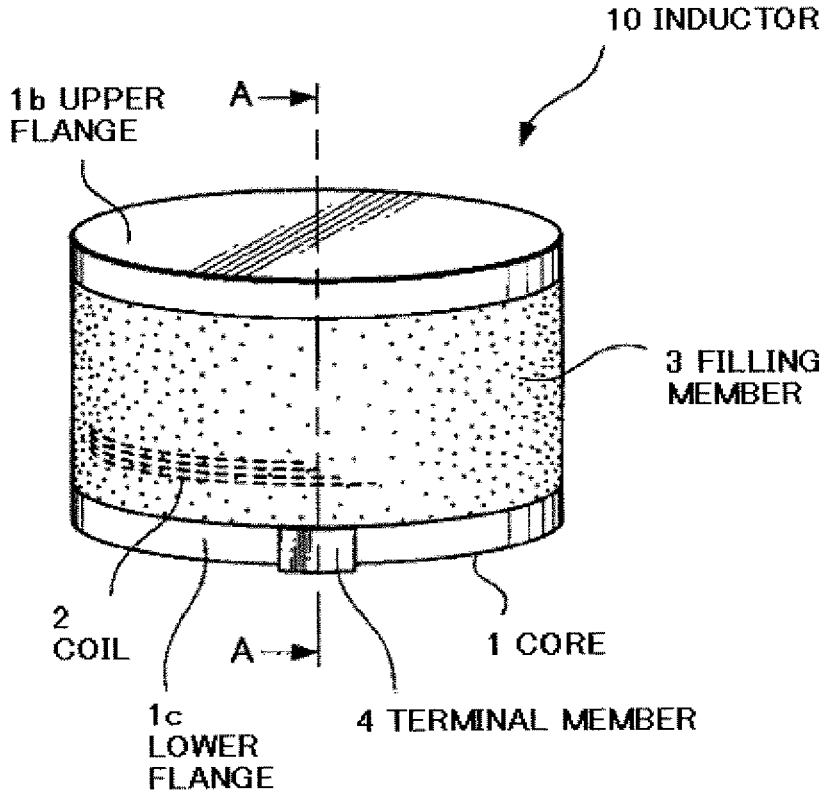
FIG. 1 is a perspective view of an inductor relating to one exemplified embodiment of the present invention.

FIG. 1 is a perspective view of an inductor 10 relating to one exemplified embodiment of the present invention. As shown in FIG. 1, the inductor 10 includes a core 1, a coil 2 wound on the core 1, a filling member 3 coating the coil 2 and a connection terminal 4.

The core 1 is a drum type core having an upper flange 1*b*, a lower flange 1*c* and a winding core portion 1*a* which is provided so as to link the upper flange 1*b* and the lower flange 1*c*.

The core 1 is molded by a compound material which is constituted by mixing a soft magnetic metal material of sendust or the like as a magnetic material and a thermo-setting epoxy resin or the like as a resin material. In addition, instead of the thermo-setting resin, it is also allowed to use a thermoplastic resin of poly phenylene sulfide (PPS) or the like. Here, the mixing ratio of the soft magnetic metal material and the resin is set with reference to the volume ratio thereof such that the mixture will include from 30 vol % to 70 vol % of the soft magnetic metal material.

When the volume ratio of the soft magnetic metal material is less than 30%, it becomes impossible for the magnetic permeability to be maintained at a suitable value, and when it is more than 70%, it becomes impossible for the molding flowability to be maintained. In the mixture ratio mentioned above, the larger the resin compounding ratio is made, the more the voltage effect can be withstood and an anticorrosive effect can be obtained. It should be noted that by changing the grain size distribution of the magnetic powders caused by adjusting the mixing ratio, it is possible to adjust molding flowability.

For the thermo-setting resin, it is also allowed to use a polyurethane resin and for the thermoplastic resin, it is also allowed to use a heat-resistant nylon. Generally, a thermoplastic resin is excellent in flowability compared with a thermo-setting resin, so that the core molding can be easily performed. Also, a resin having a functional group, such as epoxy, urethane, nylon and the like, is excellent in powder fillability compared with a resin without a functional group, such as PPS, LCP and the like, so that it is possible to mold a core having an excellent magnetic characteristic.

The coil 2 is formed by a wire having an insulating film thereon. Also, at both end portions of the wire, there are formed coil end portions 2*a*, only one of which is shown, for flowing an electric current supplied from an electronic apparatus in which the inductor 10 is mounted. The coil 2 is housed in the core by winding the wire around the winding core portion 1*a* of the core 1 while rotating the core 1.

The filling member 3 is constituted by a compound material which is obtained by mixing a soft magnetic metal material of sendust or the like as a magnetic material and a thermo-setting epoxy resin or the like as a resin material. This filling member is filled between the upper flange 1*b* and the lower flange 1*c* of the core 1 so as to cover the surface of the coil 2.

The terminal member 4 is formed by a metal plate processed in a flat plate shape. It should be noted that the metal terminal member 4 is attached on the lower flange 1*c* of the core 1 so as not to contact the filling member 3. In this manner, by attaching the terminal member 4 so as not to contact the filling member 3, it is possible to prevent a phenomenon that the electric current supplied from the electronic apparatus or the like mounted with the inductor 10 happens to leak from the terminal member 4 to the filling member 3. It should be noted that the terminal member 4 is attached also at a symmetrical position on the opposite side of the lower flange 1*c* and the coil end portion 2*a* is connected to the terminal member 4 on each side.

Figure 2:
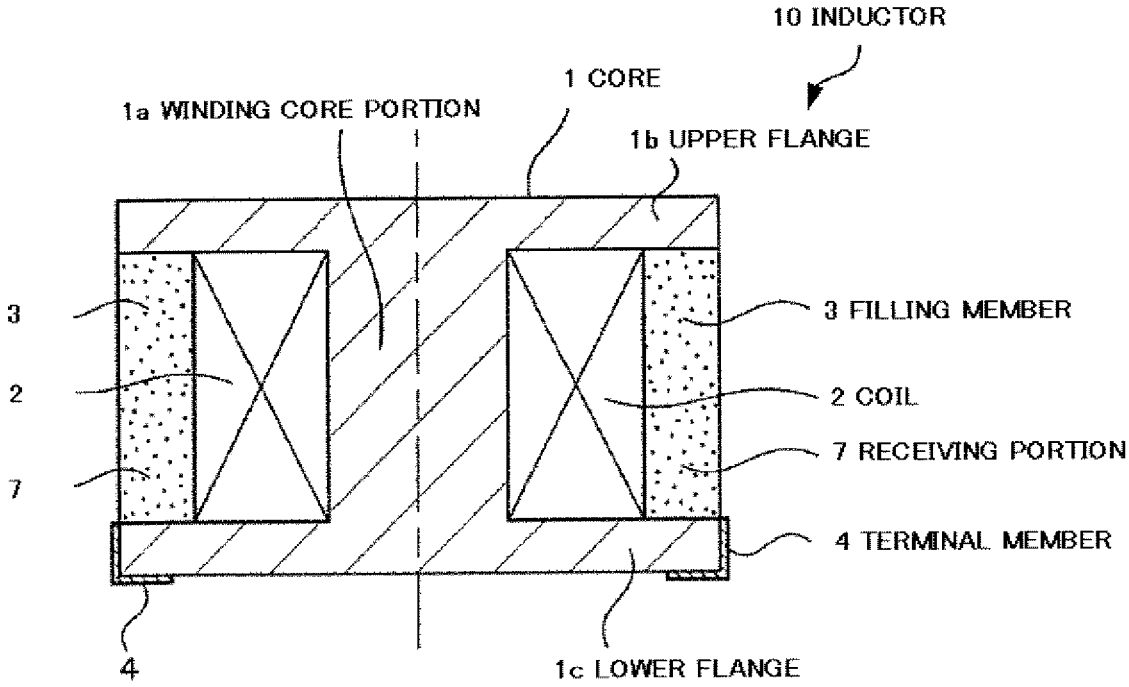
FIG. 2 is a vertical cross-sectional view of the inductor of FIG. 1.

FIG. 2 is a cross-sectional view on an A-A line of the inductor 10 shown in FIG. 1. As shown in FIG. 2, the coil 2 is wound on the winding core portion 1*a* of the core 1. The connection terminal 4 is bent in an L-shape and is attached from the bottom surface to the side surface of the lower flange 1*c*. Thus, the connection terminal 4 is connected to the electronic apparatus mounted with the inductor 10 and the electric current supplied from the electronic apparatus is supplied from the coil end portion 2*a* to the inductor 10 through the terminal member 4. Also, the pasty filling member 3 is filled in a receiving portion 7 formed by the end portion of the upper flange 1*b*, the end portion of the lower flange 1*c* and the surface of the coil 2 and coats the surface of the coil 2.

At that time, it is also allowed for the compound material to be adjusted such that the linear expansion coefficient of the compound material constituting the filling member 3 and the linear expansion coefficient of the compound material constituting the core 1 will become equal. Thus, the linear expansion coefficients of the compound material of the filling member 3 and the compound material of the core 1 are made to approach each other so that it is possible to approximate the deformation ratio of the filling member 3 with respect to disturbance of heat or the like and the deformation ratio of the core 1, and it is possible to prevent the flange portions 1*b*, 1*c* of the core 1 from being damaged based on the deformation of the filling member 3 filled in the receiving portion 7.

According to the inductor 10 of this exemplified embodiment, since the receiving portion 7 for filling the filling material 3 for coating the coil 2 is provided, it is possible to easily coat the coil 2 which is housed in the coil component by filling the material 3 in this receiving portion 7.

Figure 3:
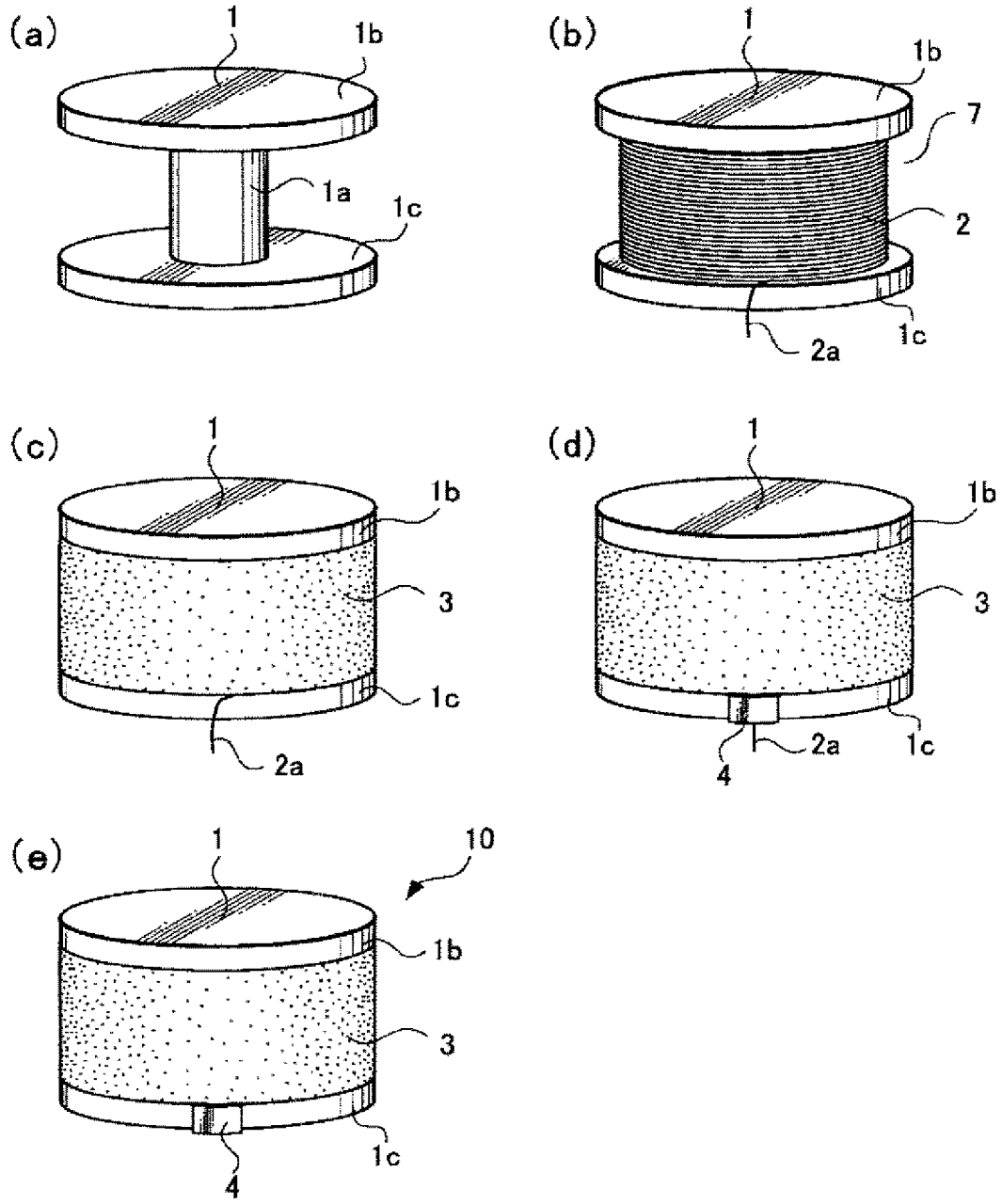
FIG. 3 are manufacturing process views for forming the inductor of FIG. 1.

Next, by using FIG. 3, one example of a manufacturing process of the inductor 10 according to this exemplified embodiment will be explained hereinafter.

First, a core 1 shown in FIG. 3A is molded by injection molding. Specifically, it is molded by using a MIM (Metal Injection Molding) method. Here, the MIM method means a complex technical method produced by merging a plastic injection molding method and a metal powder metallurgical method which have been used in the past. By injection molding which uses a die and depends on the MIM method, it is possible to easily manufacture a minute and precise component and a component of a complex shape or of a three-dimensional shape, to which a machining process is difficult to apply.

In this exemplified embodiment, by using the MIM method, it is possible to easily manufacture the core 1 having a flanged shape in which the filling member can be filled easily. Also, by manufacturing the core 1 depending on the injection molding using the composite material of the magnetic material and the resin, it is possible to increase the strength of the core 1. Further, it is possible to eliminate the cutting process when molding the core and it is possible to improve the yield of the material.

In this exemplified embodiment, metal powder and binder are mixed and kneaded uniformly (mixing and kneading process) and thereafter, by using a mixing and kneading machine, the mixture is made into pellets having excellent moldability (pelletizing process). Next, by calculating the shrinkage of the material, which is caused by temperature and pressure applied to the pellets, the die is designed (injection molding process).

Figure 4:
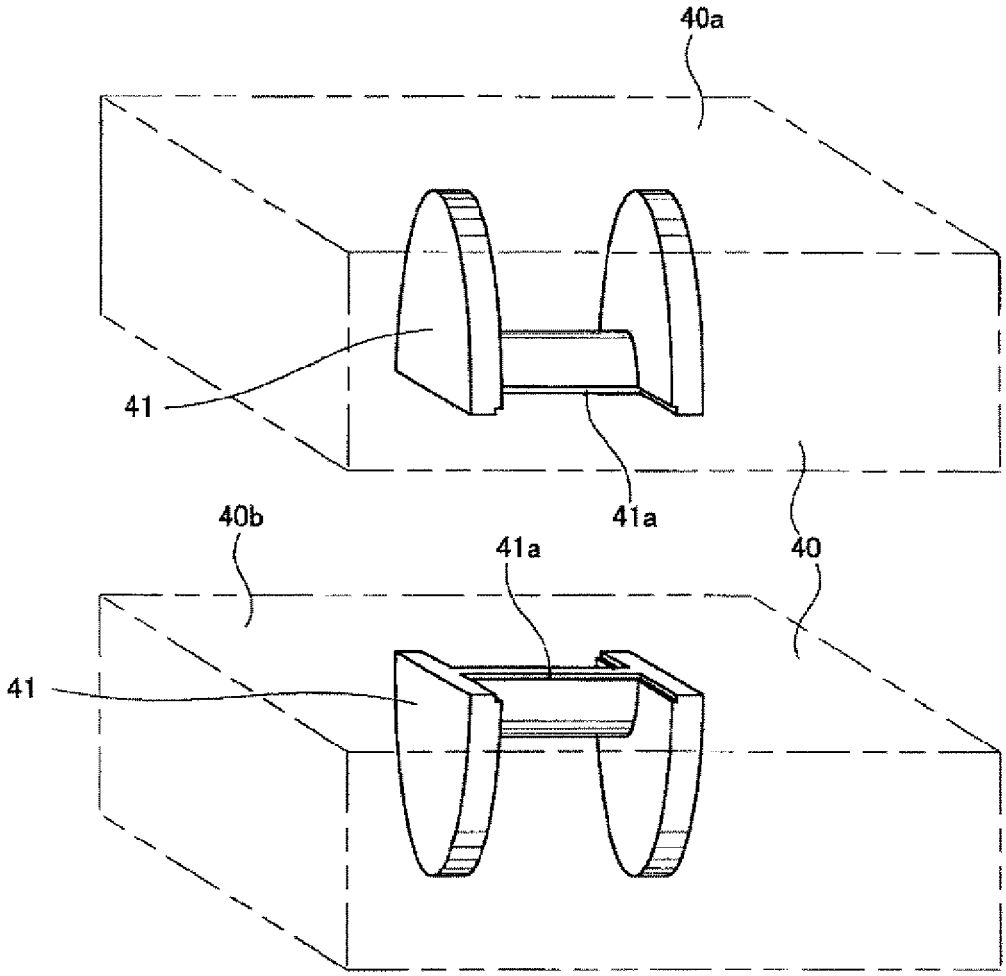
FIG. 4 is a schematic view of a die used when manufacturing the inductor of FIG. 1.
Figure 5:
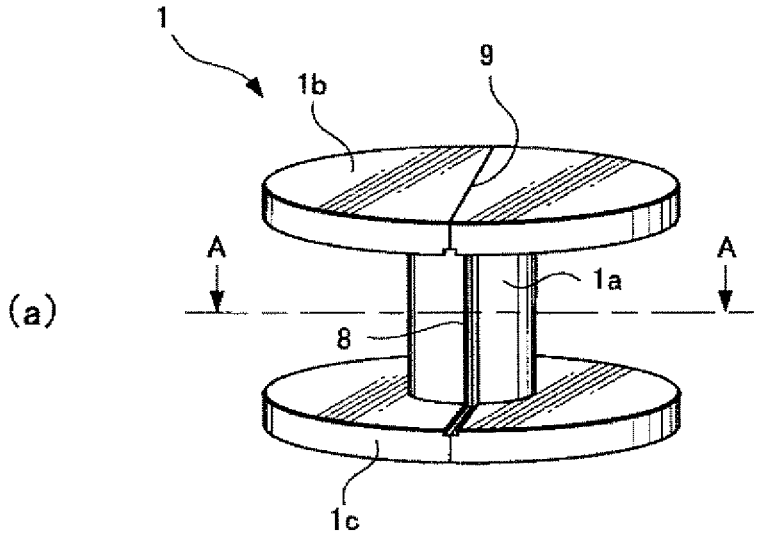
FIG. 5 are a perspective view and a horizontal cross-sectional view of a drum type core used for the inductor of FIG. 1.
Figure 5:
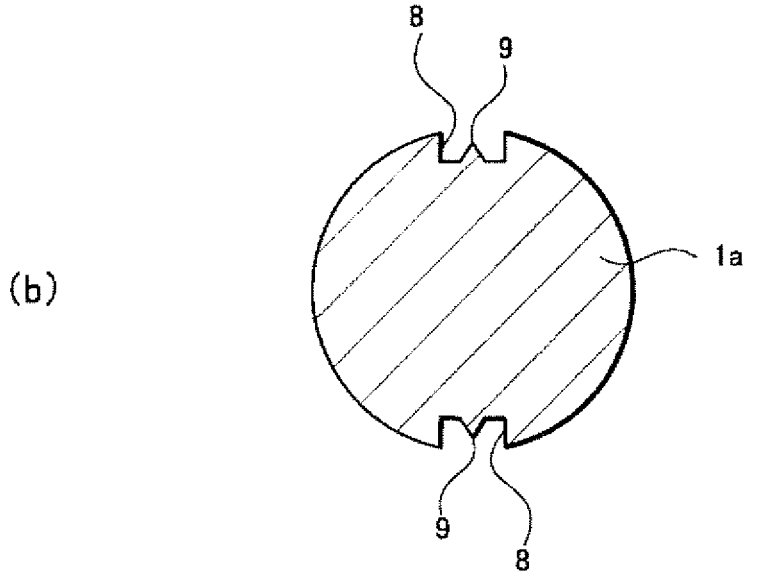

FIG. 4 is an explanatory view of a die used in the injection molding process in this exemplified embodiment. A die 40 is constituted by a combination of an upper die 40*a* and a lower die 40*b*. A model 41 of a drum core which is to be manufactured from the dies 40*a*, 40*b*, is formed in a symmetrical shape including two pieces. The upper die 40*a* and the lower die 40*b* are mated and from a predetermined injection entrance for the filling material, for example, a pasty compound material constituted by mixing a soft magnetic metal material of sendust or the like as a magnetic material and a thermo-setting epoxy resin or the like as a resin material is injected and a drum type core is manufactured. Here, if necessary, it is also allowed to employ sintering after applying binder removal.

Next, as shown in FIG. 3B, the coil 2 is wound on the winding core portion 1*a* of the core 1 formed by injection molding so as to obtain a desired number of turns. At that time, the receiving portion 7 for filling the filling member is formed by the upper flange 1*b* and the lower flange 1*c* of the core, and the wound coil 2. Also, the coil end portion 2*a* of the coil is pulled out so as to be contacted with the lower flange 1*c*.

Next, as shown in FIG. 3C, a pasty compound material constituted by mixing a soft magnetic metal material of sendust or the like as a magnetic material and a thermo-setting epoxy resin or the like as a resin material is filled in the receiving portion 7 formed among the coil 2, the upper flange 1*b* and the lower flange 1*c*, and the surface of the coil 2 is coated.

Next, as shown in FIG. 3D, the metal terminal member 4 is bonded at the lower flange 1*c* in the vicinity of the place from which the coil end portion 2*a* is pulled out. It should be noted with respect to the core formed by using the MIM method as this exemplified embodiment that the core will melt at high temperature, so that it is not possible to form an electrode by baking when the MIM method without a sintering process is used. Next, as shown in FIG. 3E, the coil end portion 2*a* and the connection terminal 4 are connected by soldering or welding.

According to a manufacturing method of the inductor 10 of this exemplified embodiment, by filling the filling material in the receiving portion 7 formed in the core 1, it is possible to easily coat the surface of the coil 2 housed in the coil component.

It should be noted that when molding using a die as mentioned above, a line-shaped protrusion (parting line) may be formed on the molded product because the resin which is filled enters into a gap formed between the upper die 40*a* and the lower die 40*b* which are mated. For this reason, as shown in FIG. 4, it is also allowed for the die 40 to form concave portions 41*a* along the winding core direction of the models 41 which are formed in the die 40.

FIG. 5A is a perspective view of a drum type core 1 manufactured by the die mentioned above. As shown in FIG. 5A, the concave portion 41*a* formed in the model 41 of the die 40 causes the core 1 to be formed with a groove line 8 which passes the winding core portion 1*a* from the upper surface end portion of the lower flange 1*c* to the lower surface end portion of the upper flange 1*b*. It should be noted that this groove 8 is formed in a similar shape also at a symmetrical position on the opposite side of the core.

FIG. 5B is a cross-sectional view on an A-A line of the core 1 shown in FIG. 5A. As shown in FIG. 5B, at the circumferential edge of the winding core portion 1*a*, there are formed grooves 8 at positions which are symmetrical. Also, as shown in the drawing, the parting line 9 mentioned above is formed in the inside of the groove 8. In this manner, by using the die 40 in which the parting line 9 is formed in the inside of the groove 8, it is possible, in case of winding the coil 2 around the winding core portion 1*a*, to prevent the wire from being damaged by the parting line 9 formed on the core.

Second Exemplified Embodiment

Next, a second exemplified embodiment of a coil component of the present invention will be explained with reference to FIGS. 6-8.

Figure 6:
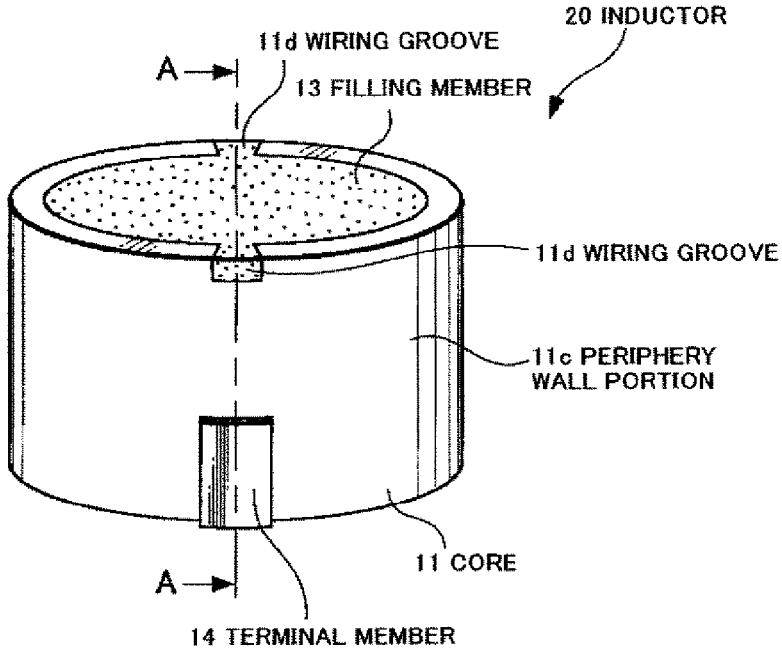
FIG. 6 is a perspective view of an inductor relating to another exemplified embodiment of the present invention.

FIG. 6 is a perspective view of an inductor 20 relating to one exemplified embodiment of the present invention. The inductor 20 relating to this exemplified embodiment includes a core 11, a coil 12 housed in the core 11, a filling member 13 coating the coil 12 and a connection terminal 14.

The core 11 is a pot type core having a circular bottom face portion 11*b*, a periphery wall portion 11*c* linked along the periphery of the bottom face portion 11*b* and an axial core portion 11*a* provided at the center of the bottom face portion 11*b*. Also, at an upper end portion of the periphery wall portion 11*c*, there are formed wiring grooves 11*d* for pulling coil end portions 12*a* of the coil 12 housed in the inside of the core 11 to the outside. It should be noted that the axial core portion 11*a*, the bottom face portion 11*b* and the coil 12 are shown in FIG. 7.

The core 11 is molded by a compound material which is constituted by mixing a soft magnetic metal material of sendust or the like as a magnetic material and a thermo-setting epoxy resin or the like as a resin material. In addition, instead of the thermo-setting resin, it is also allowed to use a thermoplastic resin of poly phenylene sulfide (PPS) or the like. Here, the mixing ratio of the soft magnetic metal material and the resin is set with reference to the volume ratio thereof such that the mixture will include from 30 vol % to 70 vol % of the soft magnetic metal material.

When the volume ratio of the soft magnetic metal material is less than 30%, it becomes impossible for the magnetic permeability to be maintained at a suitable value, and when it is more than 70%, it becomes impossible for the molding flowability to be maintained. In the mixture ratio mentioned above, the larger the resin compounding ratio is made, the more the voltage effect can be withstood and an anticorrosive effect can be obtained. It should be noted that by changing the grain size distribution of the magnetic powders caused by adjusting the mixing ratio, it is possible to adjust molding flowability.

For the thermo-setting resin, it is also allowed to use a polyurethane resin and for the thermoplastic resin, it is also allowed to use a heat-resistant nylon. Generally, a thermoplastic resin is excellent in flowability compared with a thermo-setting resin, so that the core molding can be easily performed. Also, a resin having a functional group, such as epoxy, urethane, nylon and the like, is excellent in powder fillability compared with a resin without a functional group, such as PPS, LCP and the like, so that it is possible to mold a core having an excellent magnetic characteristic.

The coil 12 is an air core coil having an air core coil portion 12*b* formed by a wire having an insulating film. Also, at both end portions of the wire, there are formed coil end portions 12*a* for flowing an electric current supplied from an electronic apparatus in which the inductor 20 is mounted. It should be noted that one of the coil end portions 12*a* and the air core portion 12*b* are shown in FIG. 8.

The filling member 13 is constituted by a compound material which is obtained by mixing a soft magnetic metal material of sendust or the like as a magnetic material and a thermo-setting epoxy resin or the like as a resin material. This filling member is filled between the periphery wall portion 11*c* of the core 11 and the upper surface of the coil 12 so as to cover the upper surface of the coil 12.

The terminal member 14 is formed by a metal plate processed in a flat plate shape. The terminal member 14 is attached to the periphery wall portion 11*c* below the wiring groove 11*d*. In addition, the terminal member 14 is attached also at a symmetrical position on the opposite side of the periphery wall portion 11*c* and the coil end portion 12*a* is connected to the terminal member 14 on each side.

Figure 7:
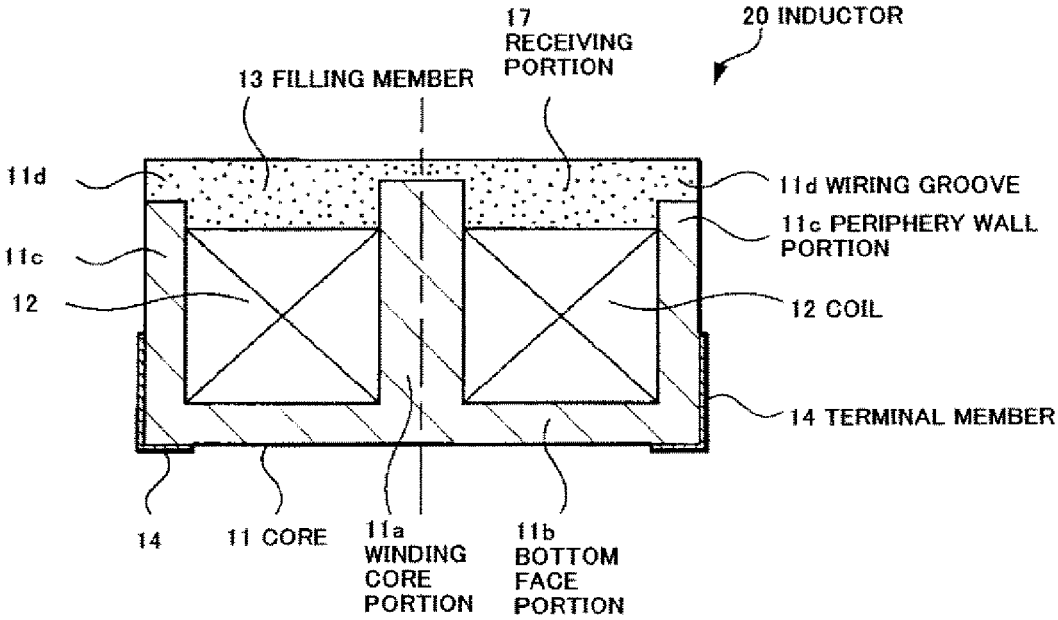
FIG. 7 is a vertical cross-sectional view of the inductor of FIG. 6.
Figure 8:
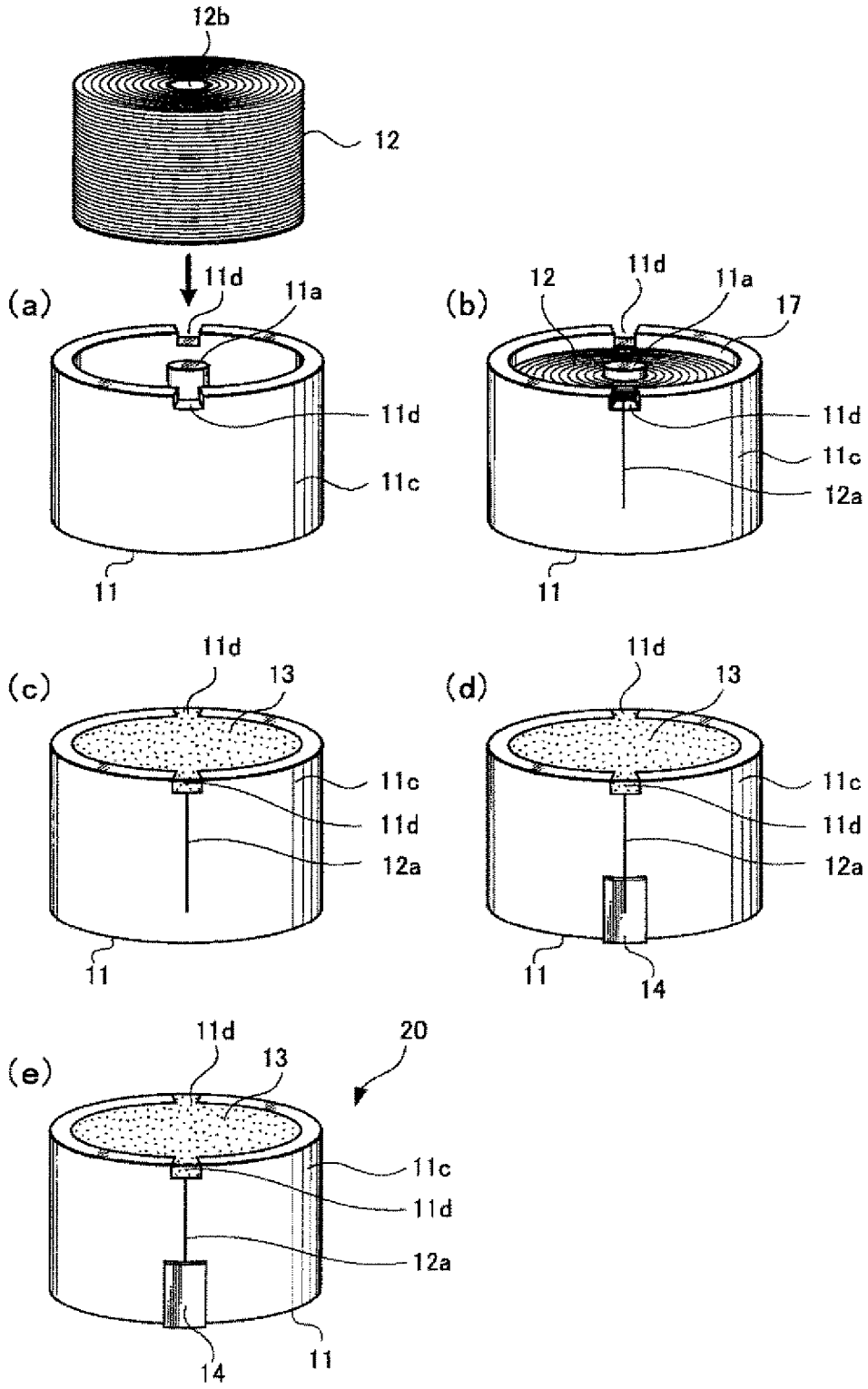
FIG. 8 are manufacturing process views of the inductor of FIG. 6.

FIG. 7 is a cross-sectional view on an A-A line of the inductor 20 shown in FIG. 6. As shown in FIG. 7, the air core coil 12 is housed on the axial core portion 11*a* of the core 11 by inserting the air core portion 12*b* of the air core coil 12 over the axial core portion 11*a*. The connection terminal 14 is bent in an L-shape and is attached from the bottom face portion 11*b* to the periphery wall portion 11*c*. Thus, the connection terminal 14 is connected to the electronic apparatus mounted with the inductor 20 and the electric current supplied from the electronic apparatus is supplied from the coil end portion 12*a* to the inductor 20 through the terminal member 14. Also, the pasty filling member 13 is filled in a receiving portion 17 formed by the inner surface of the periphery wall portion 11*c*, the protruding portion of the axial core portion 11*a* and the upper surface of the coil 12 and coats the surface of the coil 12.

At that time, it is also allowed for the compound material to be adjusted such that the linear expansion coefficient of the compound material constituting the filling member 13 and the linear expansion coefficient of the compound material constituting the core 11 will become equal. Thus, the linear expansion coefficients of the compound material of the filling member 13 and the compound material of the core 11 are made to approach each other so that it is possible to approximate the deformation ratio of the filling member 13 with respect to disturbance of heat or the like and the deformation ratio of the core 11, and it is possible to prevent the axial core portion 11*a* and the periphery wall portion 11*c* of the core 11 from being damaged based on the deformation of the filling member 13 filled in the receiving portion 17.

According to the inductor 20 of this exemplified embodiment, since the receiving portion 17 for filling the filling material 13 for coating the coil 12 is provided, it is possible to easily coat the coil 12 which is housed in the coil component by filling the material 13 in this receiving portion 17.

Next, by using FIG. 8, one example of a manufacturing process of the inductor 20 according to this exemplified embodiment will be explained hereinafter.

First, a pot type core 11 shown in FIG. 8A is molded by injection molding. Specifically, it is molded by using a MIM (Metal Injection Molding) method. In this exemplified embodiment, by using the MIM method, it is possible to easily manufacture the core 11 having the periphery wall portion 11*c* in which the filling member can be filled easily. Also, by manufacturing the core 11 depending on the injection molding using the composite material of the magnetic material and the resin, it is possible to increase the strength of the core 11. Further, it is possible to eliminate the cutting process when molding the core and it is possible to improve the yield of the material.

In this exemplified embodiment, metal powder and binder are mixed and kneaded uniformly (mixing and kneading process) and thereafter, by using a mixing and kneading machine, the mixture is made into pellets having excellent moldability (pelletizing process). Next, by calculating the shrinkage of the material, which is caused by temperature and pressure applied to the pellets, the die is designed (injection molding process).

Next, as shown in FIG. 8B, the air core portion 12*b* of the air core coil 12 is inserted onto the axial core portion 11*a* of the core 11 molded by injection molding. At that time, the receiving portion 17 for filling the filling member is formed by the periphery wall portion 11*c* of the core, the axial core portion 11*a* and the upper surface of the coil 12. Also, the coil end portion 12*a* of the coil is pulled to the outside through the wiring groove 11*d*.

Next, as shown in FIG. 8C, the pasty compound material constituted by mixing a soft magnetic metal material of sendust or the like as a magnetic material and a thermo-setting epoxy resin or the like as a resin material is filled in the receiving portion 17 formed among the periphery wall portion 11*c*, the axial core portion 11*a* and the upper surface of the coil 12, and the upper surface of the coil 12 is coated. At that time, it is also allowed to fill the filling material into the wiring groove 11*d* formed at the periphery wall portion 11*c*.

Next, as shown in FIG. 8D, the metal terminal member 14 is bonded at the periphery wall portion 11*c* in the vicinity of the place from which the coil end portion 12*a* is pulled out. It should be noted with respect to the core formed by using the MIM method as this exemplified embodiment that the core will melt at high temperature, so that it is not possible to form an electrode by baking when the MIM method without a sintering process is used.

Next, as shown in FIG. 8E, the coil end portion 12*a* and the connection terminal 14 are connected by soldering or welding. At that time, in order to prevent disconnection of the wire of the coil which is pulled to the outside of the core, it is also allowed for the wire pulled out from the wiring groove 11*d* to be applied with a silicon resin, an epoxy resin or the like which has an electrical insulation property.

According to a manufacturing method of the inductor 20 of this exemplified embodiment, by filling the filling material in the receiving portion 17 formed in the core 11, it is possible to easily coat the upper surface of the coil 12 housed in the coil component.

Third Exemplified Embodiment

Next, a third exemplified embodiment of a coil component of the present invention will be explained with reference to FIGS. 9-11.

Figure 9:
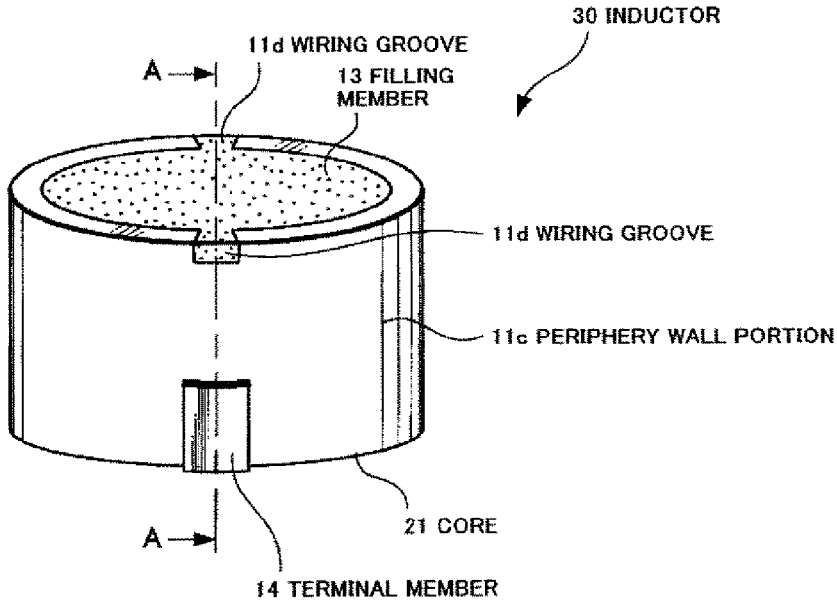
FIG. 9 is a perspective view of an inductor relating to a further exemplified embodiment of the present invention.

FIG. 9 is a perspective view of an inductor 30 relating to one exemplified embodiment of the present invention. In FIGS. 9-11, the same reference numerals are applied to portions corresponding to those in FIGS. 6-8 and the explanation thereof will be omitted. The inductor 30 relating to this exemplified embodiment includes a core 21 and a coil 12 which is housed in the core 21, a filling member 13 coating the coil 12 and a connection terminal 14.

The core 21 is a pot type core having a circular bottom face portion 11*b* and a periphery wall portion 11*c* linked along the periphery of the bottom face portion 11*b*. Also, at the upper end portion of the periphery wall portion 11*c*, there are formed wiring grooves 11*d* for pulling out end portions 12*a* of the coil 12 housed in the inside of the core 21.

The core 21 is molded by a compound material which is constituted by mixing a soft magnetic metal material of sendust or the like as a magnetic material and a thermo-setting epoxy resin or the like as a resin material. In addition, instead of the thermo-setting resin, it is also allowed to use a thermoplastic resin of poly phenylene sulfide (PPS) or the like. Here, the mixing ratio of the soft magnetic metal material and the resin is set with reference to the volume ratio thereof such that the mixture will include from 30 vol % to 70 vol % of the soft magnetic material.

When the volume ratio of the soft magnetic metal material is less than 30%, it becomes impossible for the magnetic permeability to be maintained at a suitable value, and when it is more than 70%, it becomes impossible for the molding flowability to be maintained. In the mixture ratio mentioned above, the larger the resin compounding ratio is made, the more the voltage effect can be withstood and an anticorrosive effect can be obtained. It should be noted that by changing the grain size distribution of the magnetic powders caused by adjusting the mixing ratio, it is possible to adjust molding flowability.

For the thermo-setting resin, it is also allowed to use a polyurethane resin and for the thermoplastic resin, it is also allowed to use a heat-resistant nylon. Generally, a thermoplastic resin is excellent in flowability compared with a thermo-setting resin, so that the core molding can be easily performed. Also, a resin having a functional group, such as epoxy, urethane, nylon and the like, is excellent in powder fillability compared with a resin without a functional group, such as PPS, LCP and the like, so that it is possible to mold a core having an excellent magnetic characteristic.

The coil 12, the filling member 13 and the terminal member 14 are similar to those explained in the second exemplified embodiment, so that the explanation thereof will be omitted.

Figure 10:
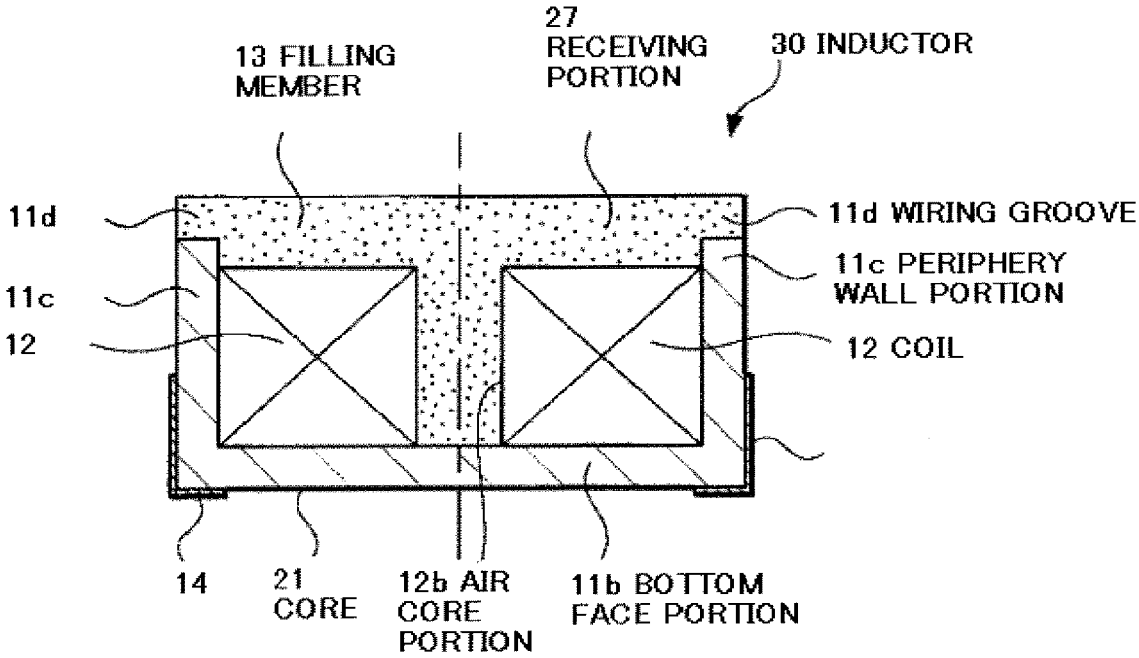
FIG. 10 is a vertical cross-sectional view of the inductor of FIG. 9.
Figure 11:
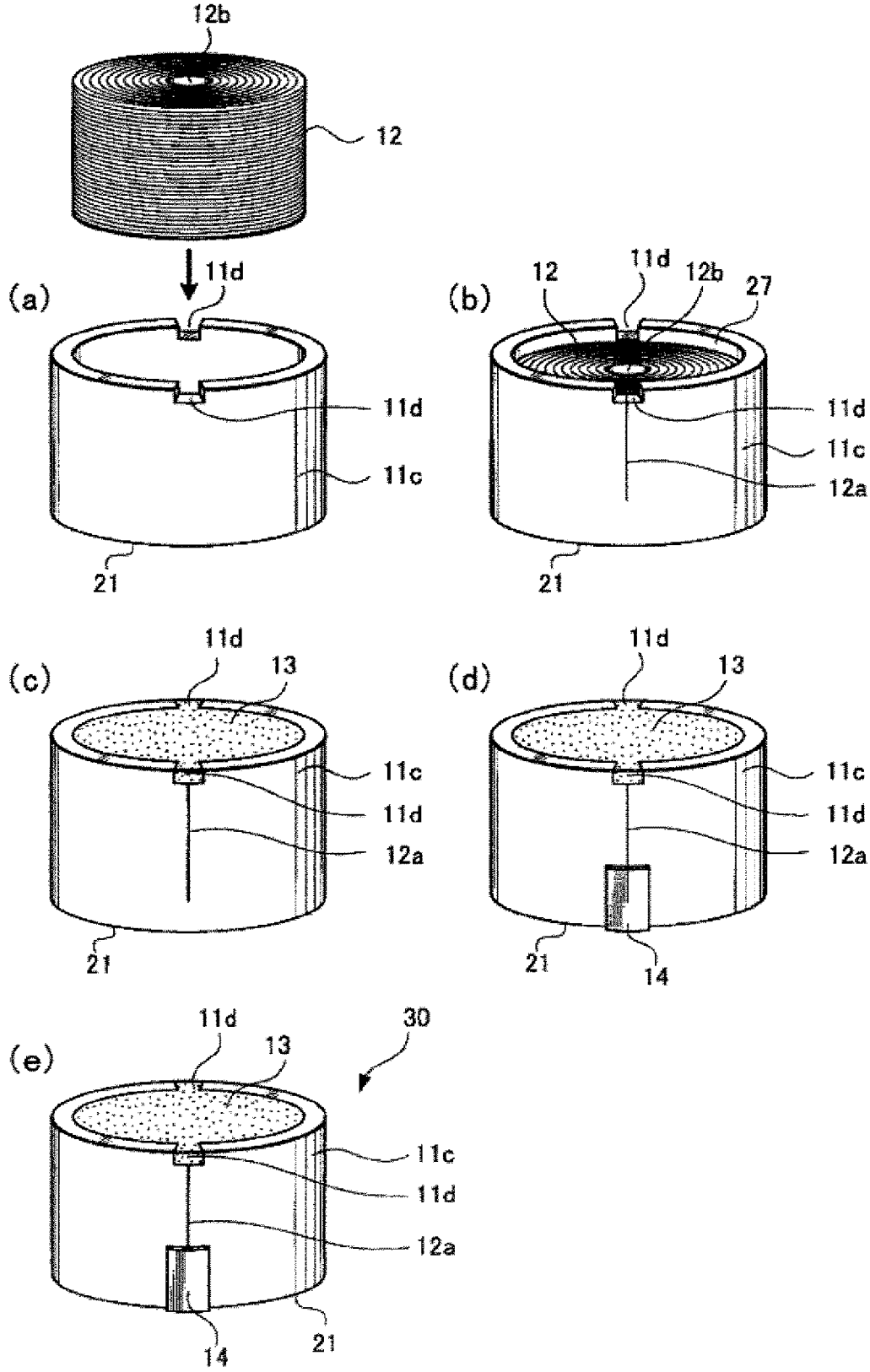
FIG. 11 are manufacturing process views of the inductor of FIG. 9.

FIG. 10 is a cross-sectional view on an A-A line of the inductor 30 shown in FIG. 9. As shown in FIG. 10, the coil 12 is housed in the inside of the core 21 by placing the air core coil 12 on the bottom face portion 11*b*. The connection terminal 14 is bent in an L-shape and is attached from the bottom face portion 11*b* to the periphery wall portion 11*c*. Thus, the connection terminal 14 is connected to the electronic apparatus mounted with the inductor 30 and the electric current supplied from the electronic apparatus is supplied from the coil end portion 12*a* to the inductor 30 through the terminal member 14. Also, the filling member 13 is filled in a receiving portion 27 formed by the inner surface of the periphery wall portion 11*c*, the air core portion 12*b* of the air core coil and the upper surface of the coil 12 and coats the surface of the coil 12.

At that time, it is also allowed for the compound material to be adjusted such that the linear expansion coefficient of the compound material constituting the filling member 13 and the linear expansion coefficient of the compound material constituting the core 21 will become equal. Thus, the linear expansion coefficients of the compound material of the filling member 13 and the compound material of the core 21 are made to approach each other so that it is possible to approximate the deformation ratio of the filling member 13 with respect to disturbance of heat or the like and the deformation ratio of the core 21, and it is possible to prevent the periphery wall portion 11*c* of the core 21 from being damaged based on that the deformation of the filling member 13 filled in the receiving portion 27.

According to the inductor 30 of this exemplified embodiment, since the receiving portion 27 for filling the filling material 13 for coating the coil 12 is provided, it is possible to easily coat the coil 12 which is housed in the coil component by filling the material 13 in this receiving portion 27.

Next, by using FIG. 11, one example of a manufacturing process of the inductor 30 according to this exemplified embodiment will be explained hereinafter.

First, a pot type core 21 shown in FIG. 11A is formed by injection molding. Molding using a MIM (Metal Injection Molding) method is similar to the second exemplified embodiment, so that the explanation thereof will be omitted.

Next, as shown in FIG. 11B, the air core coil 12 is housed in the core 11 formed by injection molding. At that time, the receiving portion 27 for filling the filling member is formed by the periphery wall portion 11*c* of the core, the air core portion 12*b* of the coil 12 and the upper surface of the coil 12. Also, the coil end portion 12*a* of the coil is pulled to the outside through the wiring groove 11*d*.

Next, as shown in FIG. 11C, the pasty compound material constituted by mixing a soft magnetic metal material of sendust or the like as a magnetic material and a thermo-setting epoxy resin or the like as a resin material is filled in the receiving portion 27 formed among the periphery wall portion 11*c*, the air core portion 12*b* of the coil and the upper surface of the coil 12, and the surface of the coil 12 is coated. At that time, it is also allowed to fill the compound material into the wiring groove 11*d* formed at the periphery wall portion 11*c*.

Next, as shown in FIG. 11D, the metal connection terminal 14 is bonded at the periphery wall portion 11*c* in the vicinity of the place from which the coil end portion 12*a* is pulled out. It should be noted with respect to the core formed by using the MIM method as this exemplified embodiment that the core will melt at high temperature, so that it is not possible to form an electrode by baking when the MIM method without a sintering process is used.

Next, as shown in FIG. 11E, the coil end portion 12*a* and the connection terminal 14 are connected by soldering or welding. At that time, in order to prevent disconnection of the wire of the coil which is pulled out, it is also allowed for the wire pulled out from the wiring groove 11*d* to be applied with a silicon resin, an epoxy resin or the like which has an electrical insulation property.

According to a manufacturing method of the inductor 30 of this exemplified embodiment, by filling the filling material 13 in the receiving portion 27 formed in the core 21, it is possible to easily coat the upper surface and the air core portion 12*b* of the coil 12 housed in the coil component.

It should be noted that the coil component and the manufacturing method of the present invention are not limited by the respective exemplified embodiments mentioned above, and it is needless to say that various modifications and variations are available with respect to other materials, configurations and the like without departing from the constitution of the present invention.

The invention claimed is:

1. A method of manufacturing a coil component, comprising:

forming a compound magnetic core by molding a mixture including a first soft magnetic metal material and a first resin material in a die, the compound magnetic core having a receiving portion and a longitudinal plane of symmetry, the die including a first die portion for forming one portion of the compound magnetic core and a second die portion for forming another portion of the compound magnetic core, the first die portion and the second die portion being mateable at the longitudinal plane of symmetry to define a parting line on the compound magnetic core, the first die portion and the second die portion including features for forming a recessed groove along portions of the parting line in the receiving portion;

assembling a coil in the receiving portion of the compound magnetic core; and arranging a compound material including a second soft magnetic metal material and a second resin material in the compound magnetic core so as to coat the coil.

2. The manufacturing method according to claim 1, wherein the mixture has a linear expansion coefficient, the method further comprising:

adjusting the composition of the compound material such that the compound material has a linear expansion coefficient equal to the linear expansion coefficient of the mixture.

3. The manufacturing method according to claim 1, wherein the first soft magnetic material and the second soft magnetic material are the same.

* * * * *